United States Patent [19]

Ginkel

[11] 4,030,471

[45] June 21, 1977

[54] OPPOSED PISTON ENGINE

[76] Inventor: Frank Ginkel, 2611 Reed Road, Escondido, Calif. 92025

[22] Filed: Oct. 29, 1975

[21] Appl. No.: 626,660

[52] U.S. Cl. ..... 123/197 R; 123/44 R; 123/51 R

[51] Int. Cl.[2] ..... F02B 57/00; F02B 75/32

[58] Field of Search ..... 123/44 C, 44 D, 44 E, 123/44 R, 51 B, 51 BD, 51 A, 51 R, 197 R, 58 R

[56] References Cited

UNITED STATES PATENTS

| | | | |
|---|---|---|---|
| 2,234,187 | 3/1941 | Meyer | 123/44 D |
| 2,260,975 | 10/1941 | Hvid | 123/51 B |
| 2,337,245 | 12/1943 | Jacklin | 123/51 B |
| 2,558,349 | 6/1951 | Fette | 123/44 E |
| 3,885,533 | 5/1975 | Townsend | 123/44 E |
| 3,974,801 | 8/1976 | Brown | 123/58 R |

FOREIGN PATENTS OR APPLICATIONS

| | | | |
|---|---|---|---|
| 1,344,844 | 1/1963 | France | 123/44 |
| 1,006,303 | 9/1965 | United Kingdom | 123/44 E |

*Primary Examiner*—Wendell E. Burns
*Assistant Examiner*—William Randolph
*Attorney, Agent, or Firm*—Boniard I. Brown

[57] ABSTRACT

A reciprocating piston engine having rotor and stator members and wherein each piston is driven through periodic power strokes in a cylinder in one member by combustion in the cylinder and is pivotally connected to a circular cam ring which surrounds the cylinder endwise and is rotatable about its center on the other member in eccentric relation to the rotation axis of the rotor member in a manner such that the combustion powered strokes of the piston drive the rotor member in rotation. The particular engine described is an opposed piston engine wherein each engine cylinder is on the stator and contains two opposed pistons connected to the rotor by two eccentric cam rings surrounding the cylinder with their axes located at opposite sides of the rotor axis. Air is supplied to the cylinder through an intake port controlled by one piston and combustion products are exhausted from the cylinder through an exhaust port controlled by the other piston.

19 Claims, 6 Drawing Figures

OPPOSED PISTON ENGINE

BACKGROUND OF THE INVENTION

1. Field of the Invention

This invention relates generally to internal combustion engines and more particularly to a novel reciprocating piston engine embodying a unique circular cam ring arrangement for converting the periodic power strokes of each engine piston to rotation of the engine rotor. The invention relates also to a novel opposed piston engine utilizing the cam ring conversion arrangement.

2. Discussion of the Prior Art

According to one of its broader aspects, the invention provides a unique circular cam ring mechanism for converting reciprocating motion of an engine piston to rotation of the engine rotor. In this regard, it will become evident as the description proceeds that this cam ring conversion mechanism may be utilized in a single piston engine or in a multiple piston engine wherein each cylinder contains a single piston. However, the mechanism is particularly suited and primarily intended for use in and a more limited aspect of the invention is concerned with an opposed piston engine. For this reason, the invention will be described in the context of such an engine.

In an opposed piston engine, each cylinder contains a pair of pistons having piston rods extending through the ends, respectively, of the cylinder and piston heads on the adjacent inner ends of the rods. These pistons form therebetween a combustion chamber which undergoes contraction upon inward movement of the pistons toward one another through compression strokes and expansion upon outward movement of the pistons through power strokes. A combustible medium, i.e., fuel/air mixture, is supplied to this combustion chamber by inward movement of the pistons through their compression strokes. The compressed medium is then ignited to drive the pistons outwardly through their power stroke. One advantage of such an engine is the ability to achieve a given compression ratio with a shorter stroke length than required in a conventional engine for efficient breathing.

The design of an opposed piston engine presents a major problem to which this invention is addressed. This problem concerns conversion of the reciprocating motion of the engine pistons to rotary motion of the engine rotor. A variety of motion conversion arrangements have been devised for this purpose. U.S. Pat. No. 2,558,349, for example, discloses an opposed piston engine with the form of motion conversion means for converting reciprocating piston motion to rotary motion of the engine rotor.

SUMMARY OF THE INVENTION

According to one of its aspects, this invention provides an improved opposed piston engine in which reciprocating motion of the engine pistons is converted to rotary motion of the engine rotor in a new and unique way. Simply stated, this improved engine has two relatively rotatable members, one forming the engine rotor and the other a stator. One member includes at least one cylinder containing a pair of opposed pistons. The members are supported for relative rotation on a central transverse axis of the cylinder.

Surrounding each cylinder endwise in side by side relation along the rotor axis are a pair of circular cone rings having their central axes parallel to and located at opposite sides of the rotation axis, such that the rings are disposed in eccentric relation to the rotor axis. Each ring is rotatably mounted, by bearing means about the ring circumference, on the second member, i.e., the member not having the cylinder, for relative rotation of the latter member and ring on the central axis of the ring. The two pistons in each cylinderare pivotally connected to the two corresponding cam rings, respectively, in a manner such that periodic movement of the pistons through their power strokes drives the cam rings in an oscillatory motion which, in turn, drives the engine rotor in rotation relative to the stator. Engine actuating means are provided for supplying a combustible medium (fuel/air mixture) to the combustion chamber of each cylinder, effecting ignition of the medium at the ends of the piston compression strokes to drive the pistons through their power strokes, and exhausting the combustion products from the combustion chamber at the ends of the power strokes, thus to drive the engine rotor.

The particular opposed piston engine described has a plurality of cylinders on the engine stator arranged side by side along the rotor axis. The engine rotor has a cylindrical body surrounding the stator concentric with the rotor axis and rotatably mounting the cam rings by means of bearing rollers disposed between bearing surfaces about the ring perimeters and internal circular bearing surfaces on the rotor body. The axes of the cam ring pairs are displaced about the rotor axis in a manner such that the piston driven oscillatory motion of the cam rings imparts a relatively constant rotary driving torque to the engine rotor for driving the latter in rotation.

In this described opposed piston engine, each cylinder has an air intake port at one end and an exhaust port at the other end which are uncovered by the cylinder pistons near the ends of their power strokes to vent the products of the previous combustion from the cylinder combustion chamber and admit to the chamber a fresh charge of air which is mixed with fuel to provide a combustible medium for the next combustion phase. The particular engine described operates on the diesel cycle by injecting fuel into the compressed air charge in each cylinder near the ends of the compression strokes of the cylinder pistons. It will be clear from the later description, however, that the engine may be designed to operate on a spark ignition cycle. According to a feature of the invention, the exhaust port of each cylinder may be uncovered slightly before the cylinder intake port to enhance purging of combustion products from the cylinder. Air may be supplied to the cylinders under pressure produced by a rotor driven blower to provide super-charged engine operation.

A unique advantage of the engine resides in the fact that each piston may have a piston head rigid on the end of a piston rod which is guided for pure endwise reciprocation in a sleeve bearing at the end of the piston cylinder. This piston arrangement attains the two fold benefit of reduced piston fabrication cost and elimination of piston head rocking which is a major cause of cylinder, compression ring, and crankshaft bearing wear in a conventional piston engine.

As noted earlier and will appear with greater clarity from the later description, the preferred form of the engine is the opposed piston configuration described. However, it will also become evident that the cam ring arrangement of the invention for converting reciprocating piston motion to rotary motion of the engine rotor may be utilized with a single piston in each engine cylinder.

DESCRIPTION OF THE PREFERRED EMBODIMENT

Figure 1:
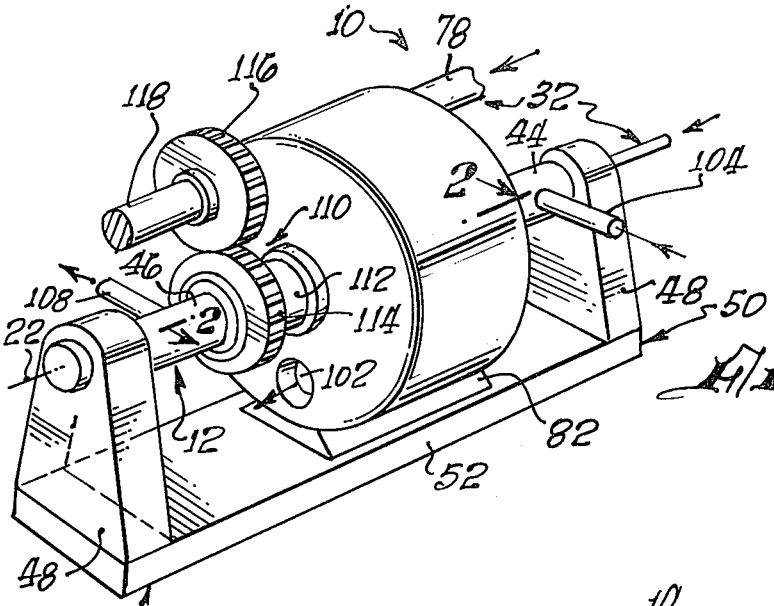
FIG. 1 is a perspective view of an opposed piston engine according to the invention.

Simply stated, the engine 10 illustrated in the drawings has a pair of relatively rotatable members 12 and 14 supported for relative rotation by supporting means 16. Member 12 includes at least one cylinder 18 and, in this instance a second cylinder 20. The members are supported, by means 16 for relative rotation on a central transverse axis 22 of the cylinders 18, 20 along with the cylinders are arranged side by side, as shown.

Within each cylinder 18, 20 are a pair of opposed pistons 24 each having a piston rod 26 which extends through one end of the corresponding cylinder and a piston head 28 on the inner end of the rod. The piston rods are slidable in bushings 29 at the cylinder ends, whereby the rods are constrained to pure endwise movement parallel to the cylinder axes. Pistons 24 are movable inwardly toward one another through compression strokes and outwardly away from one another through power strokes. The two piston heads 28 form therebetween a combustion chamber 30 which undergoes contraction during the piston compression strokes and expansion during the piston power strokes. Engine actuating means, designated generally by the rference numeral 32 are provided for supplying a combustible medium to the combustion chamber 30, effecting combustion of the medium in the chamber at the ends of the piston compression strokes to drive the pistons 24 through their power strokes and venting the combustion products from the chamber at the ends of the power strokes.

Surrounding each engine cylinder 18, 20 endwise, in side by side relation along the member rotation axis 22, are a pair of circular cam rings 34 having their central axes 36 parallel to and located at opposite sides of the axis 22 and in laterally offset relation to the longitudinal centerline of the cylinder, as shown in FIGS. 3–6. These cam rings are rotatably mounted by bearing means 38 on the engine member 14 for relative rotation of the rings and latter member on the respective ring axes. From this description, it will be understood that the cam rings are effectively eccentrically disposed relative to and in opposite lateral directions from the rotation axis 22.

Figure 2:
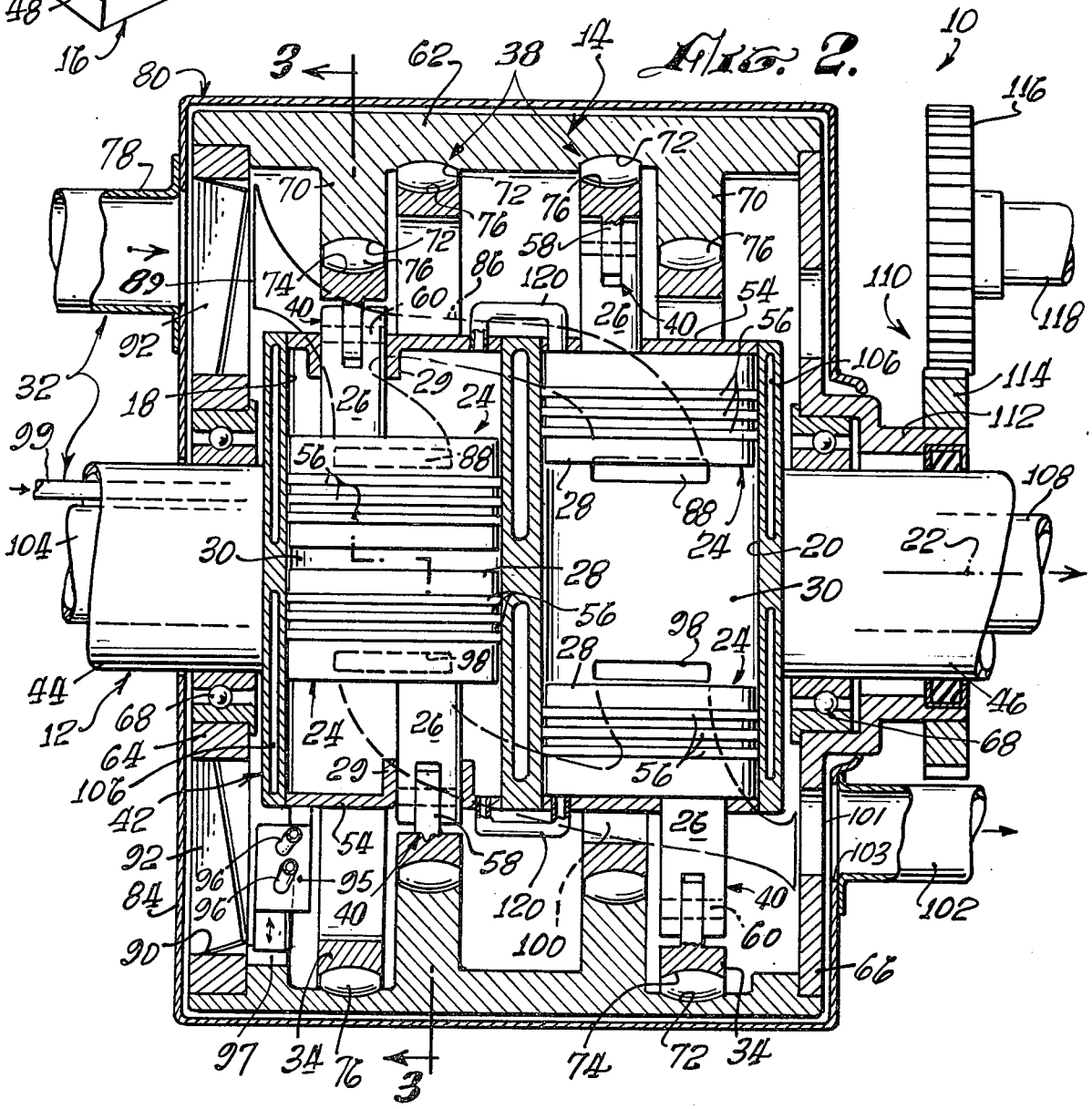
FIG. 2 is an enlarged section taken on line 2—2 in FIG. 1.

Referring to FIG. 2, it will be seen that the rods 26 of the two pistons 24 within each cylinder 18, 20 are offset in the endwise direction of the rotation axis 22 and to opposite sides of the longitudinal centerline of the cylinder so as to lie in the planes of the two cylinder cam rings 34, respectively. The outer end of the rods are pivotally connected to their adjacent cam rings by pivotal connections 40 having their pivot axes parallel to the rotation axis 22 and the cam ring axes 36.

Figure 3:
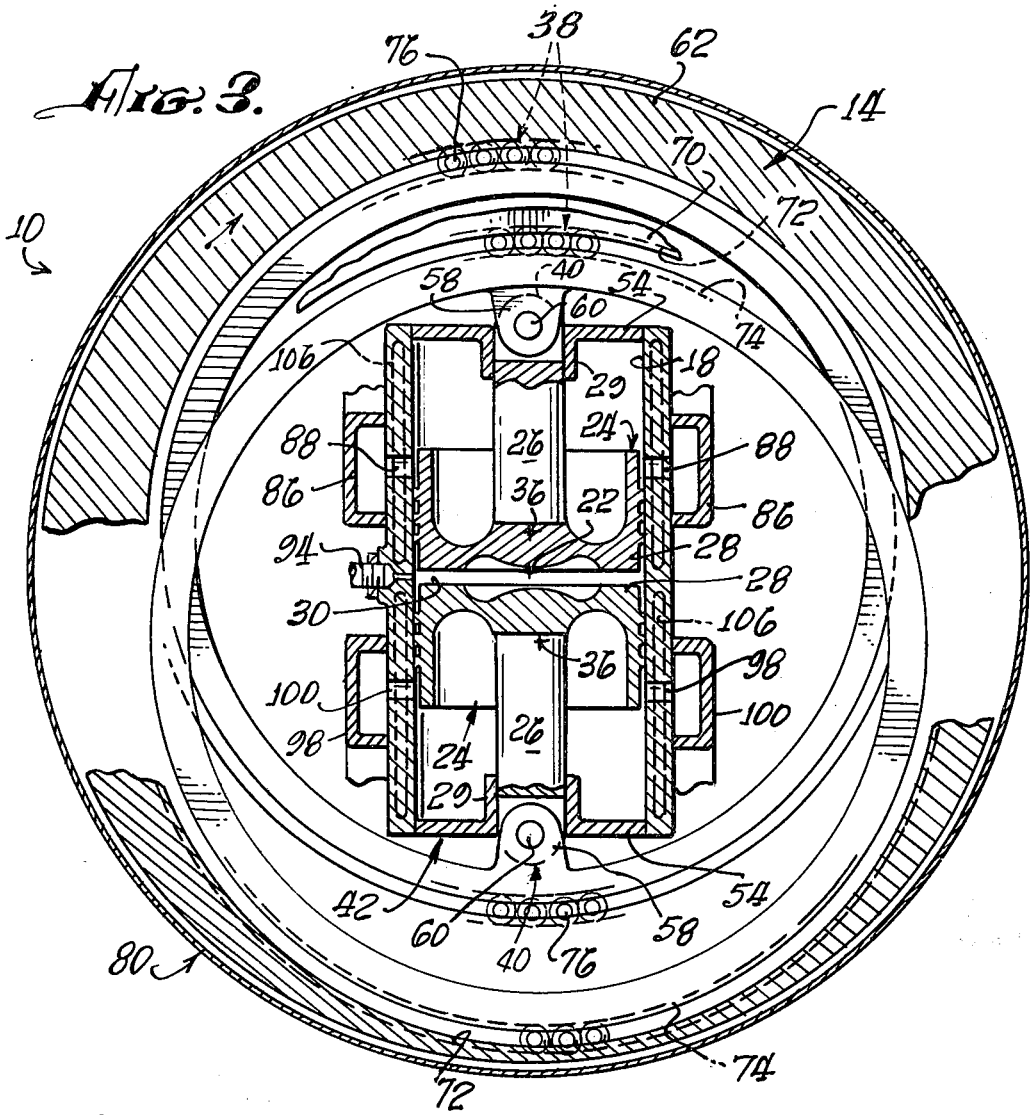
FIG. 3 is a section taken on line 3—3 in FIG. 2.
Figure 4:
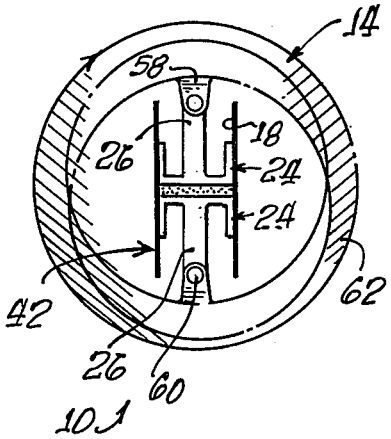
FIGS. 4, 5 and 6 illustrate, in semi-diagrammatic fashion, the engine structure of FIG. 3 in three successive operating positions.
Figure 5:
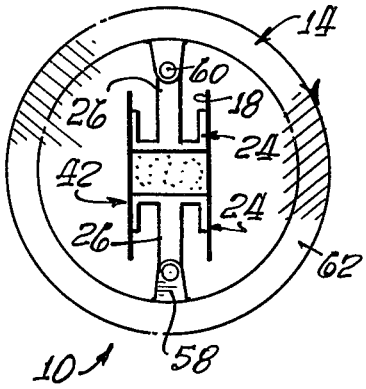
Figure 6:
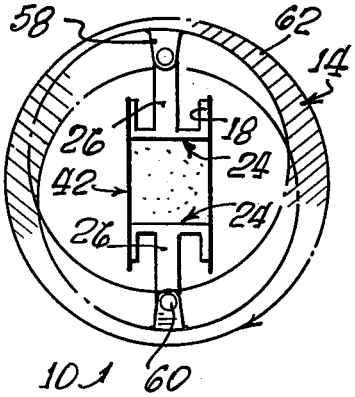

From the description to this point, it will be understood that assuming the two pistons 24 in cylinder 18 are initially at the inner ends of their compression strokes, as shown in FIGS. 3 and 4, outward movement of the pistons through their power strokes, by combustion in the cylinder combustion chamber 30, produces a torque between the engine members 12, 14 which effects relative rotation of the members through the intermediate positions of FIG. 5 to the positions of FIG. 6. The same action occurs during the power strokes of the pistons in cylinder 20. However, the axes 36 of the cam rings 34 for the latter cylinder are angularly displaced 180° about the rotation axis 22 relative to the axes of the cam rings for cylinder 18. Accordingly, when the pistons of cylinder 18 reach the ends of their power strokes (FIG. 6), the pistons of cylinder 20 are at the ends of their compression strokes (FIG. 4) and commence their power strokes to continue driving of the engine members 12, 14 in relative rotation. During this continued relative rotation, the pistons of cylinder 18 are driven, through their cam rings, inwardly through their compression strokes. The latter pistons then undergo their power strokes to drive the members 12, 14 in relative rotation and the pistons of cylinder 20 inwardly through their compression strokes. Thus, periodic movement of the pistons through their power strokes by combustion in the cylinder combustion chambers 30 drives the members 12, 14 in continuous relative rotation.

In an actual engine, of course, one of the members 12, 14 is fixed to a supporting frame, chassis or the like and forms a stator. The other member forms a rotor which is driven in rotation relative to the stator. From the description, it will be understood that either member may be stator and the other the rotor. In the particular engine shown, the cylinder member 12 is the stator and the member 14 is the rotor which is driven in rotation on the axis 22.

Referring now in more detail to the illustrated engine, the stator 12 comprises a cylinder block 42 which is machined to form the cylinders 18, 20. Rigid with and extending from opposite sides of the cylinder block are a pair of tubular shafts 44, 46 which are coaxially aligned in the rotor axis 22. This rotor axis intersects the longitudinal center lines of the cylinders 18, 20 midway between the cylinder ends. The out board ends of the stator shafts 44, 46 are supported on and rigidly fixed to upstanding lugs 48 on an engine mounting bracket 50 having a bottom mounting plate 52.

The ends of the cylinders 18, 20 are closed by end walls 54 which are joined about their edges the cylinder walls in any convenient way. These end walls are formed to provide the piston rod bushings 29.

As noted earlier, each cylinder 18, 20 contains two opposed pistons 24. The piston heads 28 slide in the cylinders and carry the customary compression rings and oil seal rings 56 for sealing the heads to the cylinder walls. The piston rods 26 extend outward from the heads parallel to the cylinder axes and slidably through the cylinder end bushings 29. Since no freedom of pivotal motion is required between the piston rods and piston heads, the rods may be forged or otherwise formed integrally with or rigidly joined to the heads, thus simplifying and reducing the cost of piston fabrication. Moreover, the piston heads are not subject to any lateral rocking movements as exist in conventional piston engines, whereby cylinder and piston ring wear is greatly reduced.

The cam rings 34 surround the cylinder block 42, with two rings encircling each cylinder 18, 20 endwise. As shown best in FIG. 2, the two rings for each cylinder are symetrically located at opposite sides of the cylinder centerline in planes normal to the rotor axis 22. The rods 26 of the pistons 24 in each cylinder are laterally offset to lie in the planes of the cylinder cam rings, respectively. The pivotal connection 40 between each piston rod 26 and its cam ring 34 comprises a tongue 58 projecting radially inward from the inner wall of the ring into a slot in the outer end of the rod and a pivot pin 60 extending through the rod and tongue.

Engine rotor 14 comprises a cylindrical body 62 surrounding the engine stator 12 concentric with the rotor axis 22. Fixed in the ends of the body are essentially annular end plates 64, 66 which surround the stator shafts 44, 46. These end plates are rotatably supported on the stator shafts by ball bearing units 68.

From the foregoing description, it will be understood that the member supporting means 16 comprises, in combination, the stator shafts 44, 46, engine mounting bracket 50, and bearings 68. This supporting means supports the rotor body 62 for rotation on the rotor axis 22.

Formed internally of the rotor body 62 are annular cam formations 70 coplanar with the cam rings 34, respectively. Each cam formation has an internal circular cam surface 72 concentrically surrounding the corresponding cam ring and facing a circular cam surface 74 about the perimeter of the ring. Between these cam surfaces are bearing rollers 76 which rotatably support the ring on the rotor body for rotation of the ring on its central axis 36. Thus, the cam surfaces 72, 74 and bearing rollers 76 constitute the cam ring bearing means 38 referred to earlier. It will be recalled from the earlier description that the cam ring axes 36 of each cylinder are laterally offset relative to the cylinder center-line in the manner shown in FIGS. 3–6, and the ring axes of the two cylinders are displaced 180° about the rotor axis 22. s 29.

As noted earlier, each cylinder 18, 20 contains two opposed pistons 24. The piston heads 28 slide in the cylinders and carry the customary compression rings and oil seal rings 56 for sealing the heads to the cylinder walls. The piston rods 26 extend outward from the heads parallel to the cylinder axes and slidably through the cylinder end bushings 29. Since no freedom of pivotal motion is required between the piston rods and piston heads, the rods may be forged or otherwise formed integrally with or rigidly joined to the heads, thus simplifying and reducing the cost of piston fabrication. Moreover, the piston heads are not subject to any lateral rocking movements as exist in conventional piston engines, whereby cylinder and piston ring wear is greatly reduced.

The cam rings 34 surround the cylinder block 42, with two rings encircling each cylinder 18, 20 endwise. As shown best in FIG. 2, the two rings for each cylinder are symetrically located at opposite sides of the cylinder centerline in planes normal to the rotor axis 22. The rods 26 of the pistons 24 in each cylinder are laterally offset to lie in the planes of the cylinder cam rings, respectively. The pivotal connection 40 between each piston rod 26 and its cam ring 34 comprises a tongue 58 projecting radially inward from the inner wall of the ring into a slot in the outer end of the rod and a pivot pin 60 extending through the rod and tongue.

Engine rotor 14 comprises a cylindrical body 62 surrounding the engine stator 12 concentric with the rotor axis 22. Fixed in the ends of the body are essentially annular end plates 64, 66 which surround the stator shafts 44, 46. These end plates are rotatably supported on the stator shafts by ball bearing units 68.

From the foregoing description, it will be understood that the member supporting means 16 comprises, in combination, the stator shafts 44, 46, engine mounting bracket 50, and bearings 68. This supporting means supports the rotor body 62 for rotation on the rotor axis 22.

Formed internally of the rotor body 62 are annular cam formations 70 coplanar with the cam rings 34, respectively. Each cam formation has an internal circular cam surface 72 concentrically surrounding the corresponding cam ring and facing a circular cam surface 74 about the perimeter of the ring. Between these cam surfaces are bearing rollers 76 which rotatably support the ring on the rotor body for rotation of the ring on its central axis 36. Thus, the cam surfaces 72, 74 and bearing rollers 76 constitute the cam ring bearing means 38 referred to earlier. It will be recalled from the earlier description that the cam ring axes 36 of each cylinder are laterally offset relative to the cylinder center-line in the manner shown in FIGS. 3–6, and the ring axes of the two cylinders are displaced 180° about the rotor axis 22. It will now be understood, therefore, that combustion driven movement of the pistons 24 through their power strokes is effective to drive the engine rotor 14 in rotation.

As noted earlier, the engine 10 has actuating means 32 for supplying a combustible medium to the cylinder combustion chambers 30, effecting combustion of the medium in the chambers at the end of the compression strokes of the pistons 24 to drive the pistons through their power strokes, and exhausting the combustion products from the cylinders at the ends of the piston power strokes. In the particular engine described this actuating means comprises an air intake duct 78 joined to the left end (in FIG. 2) of a cylindrical stator housing 80 which concentrically surrounds the rotor body 62 and is rigidly secured by a base 82 to the mounting plate 52 of the engine mounting bracket 50. The intake duct opens at one end to atmosphere, through an air filter (not shown) if desired, and at the other end through the end wall 84 of the stator housing 80 adjacent the engine rotor body end plate 64.

Contained within the rotor 14 and rigidly joined to the cylinder block 42 is an intake manifold 86 which opens at one end to the cylinder 18, 20 through intake ports 88 at one end of the cylinders. Intake manifold 86 has an opposite intake end 89 located directly opposite and opening toward the intake duct 78. This manifold intake end is disposed in close, essentially fluid sealing relation with the inner surface of the rotor body and plate 64. The rotor body end plate 64 has circumferentially spaced openings 90 containing impeller vanes 92, such that the end plate forms a blower for drawing air in through the intake duct and discharging the air under pressure to the intake manifold 86. The intake ports 88 are located to be uncovered by the adjacent cylinder piston heads 28 for admitting air underpressure to the cylinder combustion chambers 30 near the ends of the piston power strokes. During their following compression strokes, the pistons close the intake ports and compress the air in the combustion chambers.

The particular engine shown operates on the diesel cycle by injection of a measured fuel charge into the combustion chamber 30 of each cylinder near the ends of the cylinder piston compression strokes to form a combustible medium which is ignited by the heat of the compression air to drive the pistons through their following power strokes. To this end, the cylinders 18, 20 mount fuel injectors 94 which are fed with measured fuel charges in proper timing relative to the reciprocating motions of the pistons through fuel lines 96 to effect the diesel cycle operation of the engine, the pump 95 being supplied with fuel via conduit 99. The fuel pump means 95 are located within the rotor 14 and driven from the latter by cam drive means 97.

At the ends of the cylinders 18, 20 opposite the intake ports 88 are exhaust ports 98 which are uncovered by the adjacent piston heads 28 near the ends of the piston power strokes. These exhaust ports open to an exhaust manifold 100 contained within the rotor 14 and rigidly joined to the cylinder block 42. Exhaust manifold 100 has an exhaust end 101 located directly opposite and opening toward an exhaust duct 102 joined to and extending from the right end (in FIG. 2) of the stator housing 80. Exhaust manifold end 101 is disposed in close, essentially fluid sealing relation to the inner surface of the rotor body end plate 66. This end plate has openings 103 through which the exhaust manifold communicates to the exhaust duct. Thus, at the ends of the piston power strokes produced by combustion in the cylinder combustion chambers 30, the exhaust ports 98 are uncovered to vent the combustion products through the exhaust manifold 100 to the exhaust duct 102.

It will now be understood that during engine operation, air under pressure is admitted to one end of the combustion chamber 30 of each cylinder 18, 20 through the cylinder intake ports 88 and the opposite end of the chamber is vented to the exhaust duct 102 through the cylinder exhaust ports 98 at the ends of the power strokes of the cylinder pistons 24. During the following piston compression strokes, the air is compressed in the combustion chamber. Fuel is admitted into the compressed air charge at the ends of the compression strokes, thus producing a combustion in the chamber which drives the pistons through their power strokes. This action is repeated in each cylinder 18, 20 to effect driving of the rotor 14 in rotation.

According to a feature of the invention, the cam ring axes 36 of each cylinder 18, 20 are offset, as shown in FIGS. 3–6, in such a way that the cylinder exhaust ports 98 are uncovered slightly before the intake ports 88 to effect relatively completely scavenging of combustion products or exhaust gas from each cylinder. In this regard, it will be observed that the cam ring axes 36 associated with the pistons which control the exhaust ports 98 are offset from the planes which contain the rotor axis 22 and the remaining cam ring axes, such that the exhaust piston cam rings effectively lead the intake piston cam rings, thus to effect initial uncovering of the exhaust ports. This initial venting of the cylinder combustion chambers 30 to the exhaust duct 102 coupled with the supercharging or air pressuring action of the intake blower 64, 92 assures effective scavenging of the cylinders 18, 20 at the ends of the piston power strokes.

While the described engine operates on the diesel cycle, it will be obvious to those versed in the art that the engine could be designed to operate on a conventional spark ignition cycle by mixing the fuel with the intake air and providing each cylinder with a spark plug in place of the fuel injector. However, the opposed piston engine is particularly suited to diesel operation because of its ability to achieve a given compression ratio with a shorter piston stroke length than a conventional engine. It will be further obvious that while the invention has been described in connection with an opposed piston engine, the unique circular cam ring arrangement of the invention for converting reciprocating piston motion to rotary motion could be utilized in an engine with a single piston in each cylinder. In this regard, one piston of each cylinder of the illustrated engine may be considered as part of the engine actuating means for effecting admission of combustible medium, ignition of the medium, and exhausting of the cylinders to drive the other pistons through their power strokes.

The illustrated engine is liquid cooled by a coolant which enters through an inlet duct 104 extending through stator shaft 44, flows through coolant passages 106 in the cylinder block 42, and exists through an outlet duct 108 extending through stator shaft 46. The engine rotor 14 has a power take off 110 comprising a collar 112 on one end of the rotor body 62 which extends to the exterior of the engine housing 80 and mounts a pinion 114 for meshing engagement with a gear 116 on an output shaft 118. The two cylinders 18, 20 are interconnected through pressure equalizing or by-pass lines 120 to avoid pressure build-up behind the piston heads 28 during the piston power strokes. In this regard, an advantage of the engine is that the outer cylinder ends are sealed against exhaust gas leakage to provide effective pollution control.

The Inventor claims:

1. An internal combustion engine comprising:

a first member including a cylinder, a second member, means supporting said members for relative rotation on a transverse axis of said cylinder, a piston in each cylinder having an outer end extending through one end of the cylinder and an opposite inner end, each piston being movable in its cylinder through inward compression and outward power strokes and each cylinder containing a combustion chamber at the inner end of the corresponding piston which undergoes contraction during the compression strokes and expansion during the power strokes of the piston, a circular cam ring surrounding each cylinder endwise with the central axis of the ring parallel to and spaced laterally from said member rotating axis, bearing means rotatably mounting each cam ring about its circumference on said second member for relative rotation of the ring and second member on the axis of the ring, means pivotally connecting the outer end of each piston to the corresponding cam ring on a pivot axis parallel to said member rotation axis and ring axis, whereby reciprocating motion of each piston in its cylinder produces a driving torque on said members tending to drive said members in relative rotation on said member rotation axis, and engine actuating means for supplying a combustible medium to said combustion chamber of each cylinder, effecting combustion of the medium in the chamber, and exhausting combustion products from the chamber in timed relation to the strokes of the corresponding piston to drive the latter through its power strokes.

2. The engine according to claim 1 wherein:

said first member is a stator and said second member is a rotor which rotates relative to said stator.

3. The engine according to claim 1 wherein:

said second member comprises an annular body surrounding said first member and each cam ring generally concentric with said member rotation axis, and said bearing means for each cam ring comprises a circular bearing surface about the circumference of the ring concentric with the ring axis, a circular bearing surface within said body concentrically surrounding and facing the cam ring bearing surface, and bearing rollers between said bearing surfaces.

4. The engine according to claim 1 wherein:

each piston includes a piston rod having an outer end extending through the end of the corresponding cylinder and pivotally connected to the corresponding cam ring and an inner end within the cylinder, and a piston head rigid on the inner end of the rod, and each cylinder includes a bearing slidably guiding the corresponding piston rod for endwise reciprocating motion parallel to the longitudinal axis of the cylinder.

5. The engine according to claim 1 wherein:

said first member is a stator and said second member is a rotor which rotates relative to said stator, said rotor comprises an annular body surrounding said stator and each cam ring generally concentric with said member rotation axis, said bearing means for each cam ring comprises a circular bearing surface about the circumference of the ring concentric with the ring axis, a circular bearing surface within said rotor body concentrically surrounding and facing the cam ring bearing surface, and bearing rollers between said bearing surfaces, each piston includes a piston rod having an outer end extending through the end of the corresponding cylinder and pivotally connected to the corresponding cam ring and an inner end within the cylinder, and a piston head rigid on the inner end of the rod, and each cylinder includes a bearing slidably guiding the corresponding piston rod for endwise reciprocating motion parallel to the longitudinal axis of the cylinder.

6. The engine according to claim 5 including:

a housing enclosing said rotor and secured to said member supporting means, and power take-off means on said rotor accessible externally of said housing.

7. An opposed piston internal combustion engine comprising:

a first member including a cylinder, a second member, means supporting said members for relative rotation on a central transverse axis of said cylinder, a pair of opposed pistons in each cylinder having adjacent inner ends and opposite outer ends extending through the cylinder ends, the pistons in each cylinder being movable inwardly toward one another through compression strokes and outwardly away from one another through power strokes, and the inner cylinder ends forming therebetween a combustion chamber which undergoes contraction during the piston compression strokes and expansion during the piston power strokes, a pair of circular cam rings surrounding each cylinder side by side with the central axes of the rings parallel to and located at opposite sides of said member rotation axis, bearing means rotatably mounted each cam ring about its circumference on said second member for relative rotation of the ring and second member on the ring axis, means pivotally connecting the outer ends of the pistons in each cylinder to the corresponding cam rings, respectively, on pivot axes parallel to said member rotation and cam ring axes, whereby reciprocating motion of the pistons produces a driving torque on said members tending to drive the members in relative rotation on said member rotation axis, and engine actuating means for supplying a combustible medium to said combustion chamber of each cylinder, effecting combustion of the medium in the chamber, and exhausting combustion products from the chamber in timed relation to the strokes of the corresponding pistons to drive the pistons through their power strokes.

8. The engine according to claim 7 wherein:

said first member is a stator and said second member is a rotor which rotates relative to said stator.

9. The engine according to claim 7 wherein:

said second member comprises an annular body surrounding said first member and each cam ring generally concentric with said member rotation axis, and said bearing means for each cam ring comprises a circular bearing surface about the circumference of the ring concentric with the ring axis, a circular bearing surface within said body concentrically surrounding and facing the cam ring bearing surface, and bearing rollers between said bearing surfaces.

10. The engine according to claim 7 wherein:

each piston includes a piston rod having an outer end extending through the adjacent end of the corresponding cylinder and pivotally connected to the corresponding cam ring and an inner end within the cylinder, and a piston head rigid on the inner end of the rod, and each cylinder includes bearings at its ends slidably guiding the corresponding piston rods for endwise reciprocating motion parallel to the longitudinal axis of the cylinder.

11. The engine according to claim 7 wherein:

said first member is a stator and said second member is a rotor which rotates relative to said stator said rotor comprises an annular body surrounding said stator and each cam ring generally concentric with said member rotation axis, said bearing means for each cam ring comprises a circular bearing surface about the circumference of the ring concentric with the ring axis, a circular bearing surface within said rotor body concentrically surrounding and facing the cam ring bearing surface, and bearing rollers between said bearing surfaces, each piston includes a piston rod having an outer end extending through the adjacent end of the corresponding cylinder and pivotally connected to the corresponding cam ring and an inner end within the cylinder, and a piston head rigid on the inner end of the rod, and each cylinder includes bearings at its ends slidably guiding the corresponding piston rods for endwise reciprocating motion parallel to the longitudinal axis of the cylinder.

12. The engine according to claim 11 including:

a housing enclosing said rotor and secured to said member supporting means, and power take-off means on said rotor accessible externally of said housing

13. The engine according to claim 12 wherein:

said engine actuating means comprises intake and exhaust ports at the ends, respectively, of each cylinder which are uncovered by the corresponding pistons near the ends of their power strokes to communicate said ports to the cylinder combustion chamber, means for supplying air under pressure to said intake port, means for exhausting combustion products from said exhaust port to atmosphere, and means for supplying fuel to the combustion chamber.

14. The engine according to claim 13 wherein:

the axis of one cam ring for each cylinder is angularly displaced in the direction of rotation of said rotor from a plane containing said member rotation and the axis of the other cam ring of the cylinder, whereby the cylinder exhaust port is uncovered before the cylinder intake port.

15. The engine according to claim 14 wherein:

said means for supplying air under pressure to said intake port of each cylinder comprises an air passage leading to said housing communicating with the intake port and a blower in said housing connected to said rotor for receiving air through said passage and discharging the air under pressure to the intake port, and said means for exhausting combustion products from the exhaust port of each cylinder comprises an exhaust passage leading from said housing and communicating with the exhaust port.

16. The engine according to claim 15 wherein:

said engine comprises a plurality of cylinders arranged side by side along said member rotation axis, and the axes of the corresponding cylinder cam rings are angularly displaced about said member rotation axis

17. The engine according to claim 7 wherein:

said engine actuating means comprises intake and exhaust ports at the ends, respectively, of each cylinder which are uncovered by the corresponding pistons near the ends of their power strokes to communicate said ports to the cylinder combustion chamber, means for supplying air under pressure to said intake port, means for exhausting combustion products from said exhaust port to atmosphere, and means for supplying fuel to the combustion chamber

18. The engine according to claim 17 wherein:

the axis of one cam ring for each cylinder is angularly displaced in one direction of rotation of said rotor from a plane obtaining said member rotation axes and the axis of the other cam ring of the cylinder, whereby the cylinder exhaust port is uncovered before the cylinder intake port.

19. The engine according to claim 18 wherein:

said engine is a diesel engine, and said fuel supply means comprises a fuel injector at the center of each cylinder for injecting fuel into the cylinder combustion chamber near the ends of the compression strokes of the corresponding pistons.

* * * * *